United States Patent [19]

Wedel

[11] Patent Number: 4,943,351

[45] Date of Patent: Jul. 24, 1990

[54] TRANSFER APPARATUS AND METHOD

[75] Inventor: Gregory L. Wedel, Beloit, Wis.

[73] Assignee: Beloit Corporation, Beloit, Wis.

[21] Appl. No.: 197,537

[22] Filed: May 23, 1988

[51] Int. Cl.[5] ..... D21F 3/04

[52] U.S. Cl. ..... 162/205; 162/202; 162/305; 162/306; 162/307; 34/114; 34/116

[58] Field of Search ..... 162/202, 306, 307, 305, 162/205, 193; 34/114, 116

[56] References Cited

U.S. PATENT DOCUMENTS

| | | | |
|---|---|---|---|
| 4,483,745 | 11/1984 | Wicks et al. | 162/205 |
| 4,526,655 | 7/1985 | Karvinen et al. | 162/305 X |
| 4,551,203 | 11/1985 | Eskelinen | 162/306 X |
| 4,662,992 | 5/1987 | Mirsberger | 162/305 X |

*Primary Examiner*—Peter Chin
*Assistant Examiner*—Thi Dang
*Attorney, Agent, or Firm*—Dirk J. Veneman; Raymond W. Campbell; David J. Archer

[57] ABSTRACT

A transfer apparatus is disclosed for transferring a web from a press nip to a dryer section. The apparatus includes a backing roll and a press member which cooperates with the backing roll for defining therebetween the press nip. A press blanket extends through the press nip such that the web is disposed between the blanket and the backing roll during passage of the web through the press nip. A backing drum is disposed downstream relative to the press nip such that the blanket and the web extend contiguously relative to each other from the press nip to the backing drum. A dryer felt cooperates with the backing drum such that the web is disposed between the blanket and the felt during passage of the blanket, web and felt around the backing drum and a transfer mechanism is disposed adjacent to the backing drum for transferring the web without an open draw from the blanket to the felt such that the web follows the felt through the dryer section. A method for transferring the web from the press nip to the dryer section is also disclosed.

18 Claims, 8 Drawing Sheets

FIG. 1
PRIOR ART
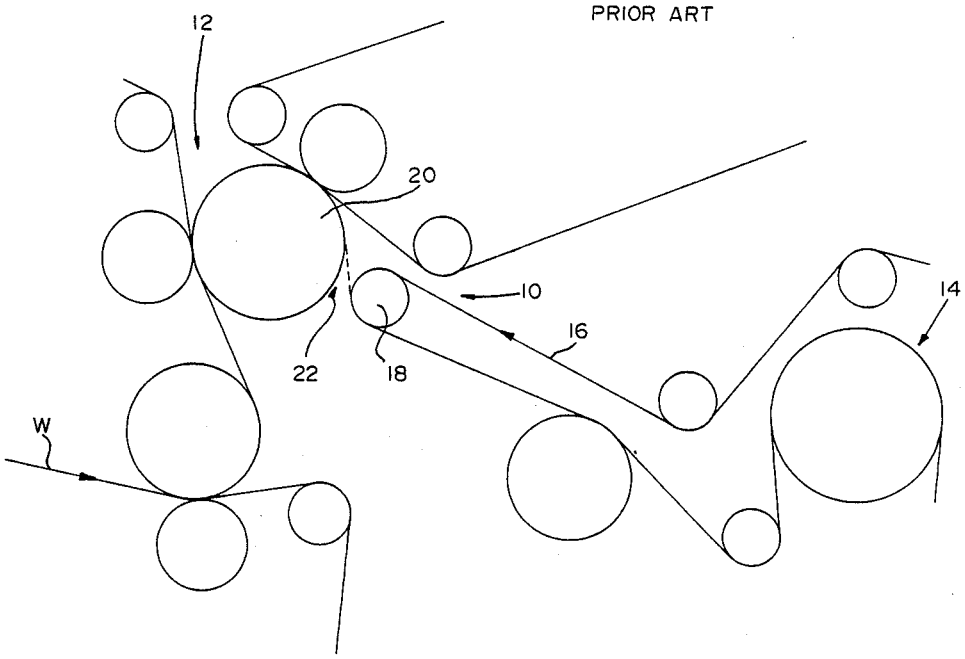
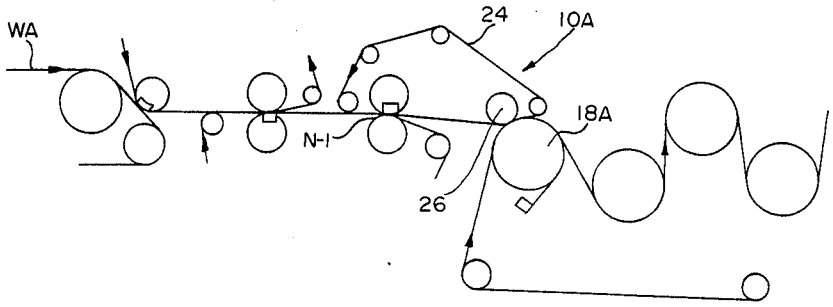
PRIOR ART
FIG. 2

PRIOR ART

TRANSFER APPARATUS AND METHOD

BACKGROUND OF THE INVENTION

FIELD OF THE INVENTION

This invention relates to a transfer apparatus for transferring a web from a press nip to a dryer section. More particularly, this invention relates to a transfer apparatus for transferring a web without an open draw from a press blanket to a dryer section.

INFORMATION DISCLOSURE STATEMENT

The transfer of a wet web from a press section to a dryer section has become a critical area in the production of lightweight grades of paper, particularly when such paper is manufactured at high speeds.

Typically, the web is transferred from the press section to the dryer section in an "open draw". The term "open draw" according to the present invention means the sheet is left unsupported for a finite length between the press section and the dryer section. During movement of the web through such "open draw", the unsupported length of the web stretches and bags and the loose web may then flutter, wrinkle or bubble on the dryer felt.

In order to minimize these problems, the "draw" is increased. The "draw" is defined as the difference between the velocity of the web through the press section and through the dryer section respectively. Such difference in velocity stretches and tightens the web but also increases the web's susceptibility to tension breaks. The "draw" also sometimes produces an undesirable change in directionality of the web properties and may produce a reduction in the width of the resultant sheet.

The present invention seeks to overcome the aforementioned problems by the elimination of such "open draw". In the past, several arrangements have been proposed in order to eliminate any "open draw", but each of these arrangements has introduced serious disadvantages.

For example, in one prior arrangement, the last press nip is double-felted and the wet web is permitted to remain in contact with one of the press felts until the web is transferred to the dryer felt at a drawless transfer point. Although this arrangement avoids the problems associated with an "open draw", it permits water in the press felt to be reabsorbed by the paper while the paper web is in contact with the press felt thereby increasing the moisture level of the web.

Another prior proposal is described in the brochure entitled "Fourth Valmet Papermachine Days". In this particular arrangement, a special transfer felt runs through a press nip and then into the dryer section so that no open draw is required. However, this arrangement requires a felt that can withstand the nip load and which will not release water to the sheet and which will also allow an easy transfer of the web to the dryer felt. Unfortunately, to-date, no such felt has been successfully designed and manufactured.

Another prior proposal is disclosed in U.S. Pat. No. 4,483,745 to Wicks, assigned to Beloit Corporation. Wicks teaches the use of an impervious belt which transfers the web from the press to the dryer section without an open draw as shown in FIGS. 2,3 and 4 of that patent. In FIG. 2 of the Wicks patent, the web must transfer from the smooth belt surface to the felt surface which is of rough texture. Such transfer is not efficient because the web has a natural tendency to follow the smooth surface. There is no provision in the Wicks disclosure of an auxiliary device to cause the transfer from the belt to the dryer section. In FIG. 3 of the Wicks patent, a vacuum roll is used to help the transfer, however, this roll must be pivoted and the contact point requires depression of the dryer felt into the porous belt. FIG. 4 of the Wicks patent does not require a vacuum roll at the transfer point, but since the sheet is sandwiched between the press belt and the lead-in roll, and both the belt and the lead-in roll have smooth surfaces, the web may unpredictably follow either surface.

The present invention overcomes the aforementioned problems of the prior proposals by providing a more positive method of transferring the web. Such positive transfer is provided by extending the press belt or blanket over a backing drum which may be a "baby dryer" or a "lead-in dryer" or an unheated roll. The aforementioned backing drum is wrapped by the dryer felt so that the web is sandwiched between the press belt and the dryer felt. In the aforementioned arrangement, the web can pass from the press section to the dryer section without an open draw. Furthermore, because the web remains in contact with the smooth surface of the belt, the web will quickly separate from the press felt and will be subject to minimal rewetting. The web which remains with the press belt can be doctored from the belt with a conventional doctor blade. When the web has been established at the doctor blade, the web can be transferred to the dryer felt by any of the following methods:

1. A tail can be blown off of the belt into ropes which carry the tail through the dryer section.
2. The dryer felt may be backed with a small vacuum box, or roll, in order to hold the tail onto the felt. With the second arrangement, the provision of threading ropes is avoided.
3. A vacuum device may be used directly to pull the web from the press belt to the dryer felt at the outgoing area of the backing drum rather than using either threading ropes or air pipes.

Therefore, the primary object of the present invention is the provision of a transfer apparatus which overcomes the aforementioned inadequacies of the prior art proposals and which provides a significant and substantial contribution to the papermaking art.

Another object of the present invention is the provision of a transfer apparatus which includes a backing drum disposed downstream relative to a press nip and a press blanket extending through the press nip around the backing drum. A dryer felt cooperates with the backing drum such that the web is disposed between the blanket and the felt so that rewetting of the web by a press felt is minimized.

Another object of the present invention is the provision of a transfer apparatus which includes transfer means disposed adjacent to the backing drum for transferring the web from the blanket to the dryer felt such that the web follows the dryer felt through the dryer section.

Another object of the present invention is the provision of a transfer apparatus in which the transfer means is a vacuum transfer roll disposed downstream relative to a backing drum such that the web is disposed between the blanket and the dryer felt from the backing drum to the vacuum transfer roll so that the web follows the dryer felt when the felt diverges relative to the blanket downstream relative to the vacuum transfer roll.

Another object of the present invention is the provision of a transfer apparatus in which the transfer means is a vacuum box which is disposed downstream relative to the backing drum with the vacuum box being disposed adjacent to a joint run of the dryer felt and the web such that the dryer felt is disposed between the web and the vacuum box.

Another object of the present invention is the provision of a transfer apparatus in which the transfer means includes a vacuum box which is disposed radially relative to the backing drum such that when the vacuum box is connected to a source of partial vacuum, air flows through the vacuum box adjacent to the backing drum for drawing the web into close conformity with the dryer felt as the dryer felt diverges relative to the blanket thereby transferring the web to the dryer felt.

Another object of the present invention is the provision of a transfer apparatus which includes an adjustable guide roll disposed downstream relative to the backing drum for guiding the blanket. The guide roll is movable towards and away from the dryer felt so that when the guide roll is disposed towards the dryer felt, the web is initially transferred from the blanket to the dryer felt. When the guide roll is disposed in a second position thereof away from the vacuum roll, the web continues to run contiguously with the dryer felt from the backing drum to the vacuum roll.

Another object of the present invention is the provision of a transfer apparatus in which the transfer means includes a vacuum roll having a rotatable shell defining a plurality of air flow passages. A vacuum chamber is disposed adjacent to the dryer felt so the air flows through the passages into the vacuum chamber for drawing the web into close conformity with the dryer felt. A pressure chamber is disposed diametrically opposite to the vacuum chamber such that air flows from the vacuum chamber through the passages outwardly away from the vacuum roll for cleaning the passages.

Another object of the present invention is the provision of a method of transferring a web from a press nip to a dryer section in which vacuum is applied to the dryer felt downstream relative to the backing drum such that when the dryer felt diverges relative to the blanket downstream relative to the backing drum, the web follows the dryer felt through the dryer section.

Other objects and advantages of the present invention will be apparent to those skilled in the art by a consideration of the detailed description contained hereinafter taken in conjunction with the annexed drawings.

SUMMARY OF THE INVENTION

The present invention relates to a transfer apparatus and method for transferring a web from a press nip to a dryer section. The apparatus includes a backing roll and a press member which cooperates with the backing roll for defining therebetween the press nip. A press blanket extends through the press nip such that the web is disposed between the blanket and the backing roll during passage of the web through the press nip. A backing drum is disposed downstream relative to the press nip such that the blanket and the web extend contiguously relative to each other from the press nip to the backing drum. A dryer felt cooperates with the backing drum such that the web is disposed between the blanket and the felt during passage of the blanket, web and felt around the backing drum. A transfer means is disposed adjacent to the backing drum for transferring the web without open draw from the blanket to the felt such that the web follows the felt through the dryer section.

More specifically, the backing roll is vented and in a preferred embodiment of the present invention, the backing roll defines a plurality of grooves such that the water removed from the web during passage of the web through the press nip flows through the grooves for venting the press nip.

In one embodiment of the present invention, the press member is a press shoe which defines a concave surface for cooperating with the backing roll for defining therebetween an extended nip.

In another embodiment of the present invention, the press member is a press roll.

In some of the embodiments of the present invention, the press blanket is an impervious belt which defines a smooth surface towards the web and the dryer felt extends around a portion of the circumference of the backing drum such that the felt, the web and the blanket together wrap around the aforementioned portion of the circumference of the backing drum with the blanket and the web being disposed between the backing drum and the felt.

In another embodiment of the present invention, the transfer means includes a vacuum transfer roll which is disposed downstream relative to the backing drum such that the web is disposed between the blanket and the felt from the backing drum to the vacuum transfer roll so that the web follows the felt without open draw when the felt diverges relative to the blanket downstream relative to the vacuum transfer roll.

In another embodiment of the present invention, the transfer means includes a vacuum box which is disposed downstream relative to the backing drum with the vacuum box being disposed adjacent to a joint run of the dryer felt and the web such that the dryer felt is disposed between the web and the vacuum box.

In another embodiment of the present invention, the transfer means includes a vacuum box which is disposed radially relative to the backing drum such that when the vacuum box is connected to a source of partial vacuum, air flows through the vacuum box adjacent to the backing drum for drawing the web into close conformity with the dryer felt as the dryer felt diverges relative to the blanket, thereby transferring the web to the dryer felt.

In another embodiment of the present invention, the transfer apparatus includes a dryer drum disposed downstream relative to the transfer means such that the dryer felt and the web extend contiguously relative to each other from the backing drum to the dryer drum.

In another embodiment of the present invention, the transfer apparatus further includes a grooved roll which is disposed downstream relative to the backing drum such that the dryer felt and the blanket extend contiguously relative to each other from the backing drum to the grooved roll.

In another embodiment of the present invention, the transfer apparatus further includes an adjustable guide roll which is disposed downstream relative to the backing drum for guiding the blanket, the guide roll being movable towards, and away from, the dryer felt. Also, the transfer means includes a vacuum roll which is disposed downstream relative to the backing drum such that the dryer felt and the web extend contiguously from the backing drum to the vacuum roll so that in a first position of the guide roll, the guide roll is disposed towards the vacuum roll so that the blanket, the web and the dryer felt extend contiguously from the backing drum to the vacuum roll for initially transferring the web from the blanket to the dryer felt. When the guide roll is disposed in a second position thereof, away from the vacuum roll, the web continues to run contiguously with, and be supported by, the dryer felt from the backing drum to the vacuum roll.

In a further embodiment of the present invention, the vacuum roll also includes a rotatable shell which defines a plurality of air flow passages. A vacuum chamber is disposed adjacent to the dryer felt such that in use of the apparatus, air flows through the passages into the vacuum chamber for drawing the web into close conformity with the dryer felt. Also, a pressure chamber is defined by the vacuum roll and is disposed diametrically opposite to the vacuum chamber such that air flows from the pressure chamber through the passages outwardly away from the vacuum roll for cleaning the passages.

In a further embodiment of the present invention, the transfer apparatus includes a doctor blade which is disposed downstream relative to the backing drum for doctoring the web from the blanket.

In another embodiment of the present invention, the transfer apparatus includes a backing roll and a press member cooperating with the backing roll for defining therebetween the press nip. A press blanket extends through the press nip such that the web is disposed between the blanket and the backing roll during passage of the web through the press nip. A dryer felt cooperates with the press member downstream relative to the press nip such that the web is disposed between the blanket and the felt downstream relative to the press nip. Transfer means are disposed downstream relative to the press nip and adjacent to the press member for transferring the web without open draw from the blanket to the felt such the web follows the felt through the dryer section.

In yet another embodiment of the present invention, the transfer means includes a suction roll disposed downstream relative to the backing drum such that in a first inoperative position of the suction roll the suction roll is disposed away from the blanket such that the web follows in close conformity with the blanket and does not transfer to the dryer felt. Whereas in a second position of the suction roll with the suction roll moved towards the blanket, the blanket, web and dryer felt move in close conformity with each other from the backing drum to the suction roll and thereafter the web transfers to the dryer felt downstream relative to the suction roll.

The present invention also includes a method for transferring a web from a press nip to a dryer section. The method includes the steps of:

- Pressing the web between a backing roll and a press member which cooperates with the backing roll for defining therebetween the press nip;
- Transporting the pressed web supported by a press blanket from the press nip towards, and around, a backing drum.
- Sandwiching the web between the blanket and a dryer felt which extends around a portion of the circumference of the backing drum.
- Applying a vacuum through the dryer felt downstream relative to backing drum such that the web follows the dryer felt without open draw through the dryer section.

Although the present invention is particularly described in the detailed description contained hereinafter, it will be appreciated by those skilled in the art that many variations and modifications of the present invention may be carried out without departing from the spirit and scope of the present invention as defined by the appended claims. Included among such modifications would be the provision of a grooved blanket instead of the smooth press blanket. Also, instead of using vacuum boxes or the like, the present invention envisages use of air nozzles or blow boxes in which air is blown through various nozzles to generate a Coanda effect for drawing the web into close conformity with the dryer felt. cl BRIEF DESCRIPTION OF THE DRAWINGS FIG. 1 is a side-elevational view of a Tri-Vent press and a prior art transfer mechanism for transferring the pressed web with an open draw to a dryer section.

FIG. 2 is a side-elevational view of a prior art transfer mechanism for transferring a web without open draw from a belt to a dryer section.

Similar reference characters refer to similar facts throughout the various embodiments of the present invention.

DETAILED DESCRIPTION OF THE DRAWINGS

Figure 3:
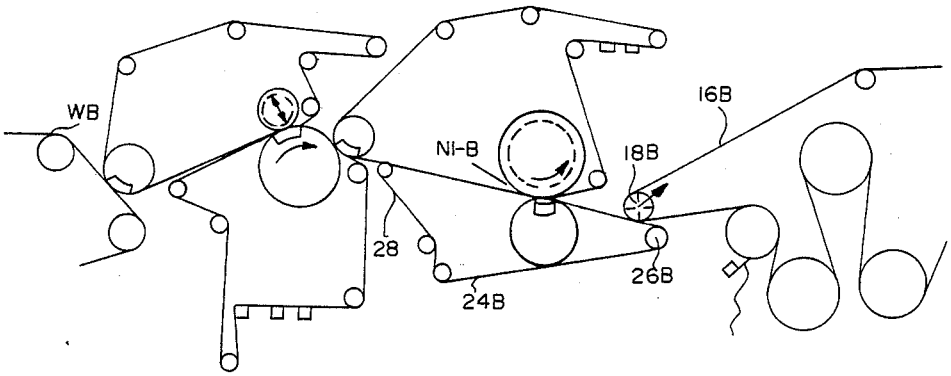
FIG.3 PRIOR ART
FIG. 3 is a side-elevational view of a modification of the prior art invention shown in FIG. 2.

FIG. 1 is a side-elevational view of a prior art web transfer mechanism generally designated 10 for transferring a web W from a Tri-Vent press section generally designated 12 to a dryer section generally designated 14. A dryer felt 16 extends around a lead-in roll 18 disposed adjacent to a press roll 20 such that the web W is transferred through an open draw 22 from the press roll 20 to the lead-in roll 18.

FIG. 2 is a side-elevational view of a prior art web transfer mechanism generally designated 10A disclosed in U.S. Pat. No. 4,483,745 issued Nov. 20, 1984 to Wicks and assigned to Beloit Corporation. FIG. 2 shows an extended nip N1 and a belt, or blanket 24, extending through the nip N1 such that the web WA adheres to, and is guided by, the belt 24 towards a lead-in roll 18A and a backing drum 26 so that the web WA is transferred from the belt 24 to the dryer section.

FIG. 3 is a side-elevational view of a further embodiment of the aforementioned U.S. Pat. No. 4,483,745 and shows an extended nip N1B and a belt 24B extending through the nip N1B and a dryer felt 16B being guided around an adjustable lead-in roll 18B so that the web WB is transferred from the smooth surface 28 of the belt 24B to the dryer felt 16B.

Figure 4:
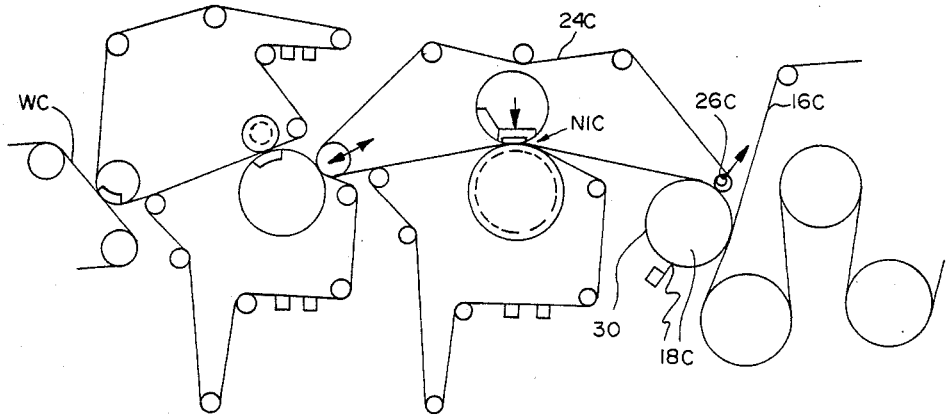
FIG. 4 is a side-elevational view of yet a further modification of the transfer mechanism shown in the prior art invention of FIG. 2.

FIG. 4 is a side-elevational view of yet a further embodiment of the invention of U.S. Pat. No. 4,483,745 and shows an extended nip N1C and a smooth, impervious belt 24C extending therethrough for guiding a web WC towards a lead-in drum 18C such that the web WC is transferred from the belt 24C to the drum 18C without open draw. However, as the belt 24C has a smooth surface and the surface 30 of the drum 18C is also smooth, the web WC will not always predictably follow the smooth surface 30 of the drum 18C for transferring the web WC to the dryer felt 16C.

Figure 5:
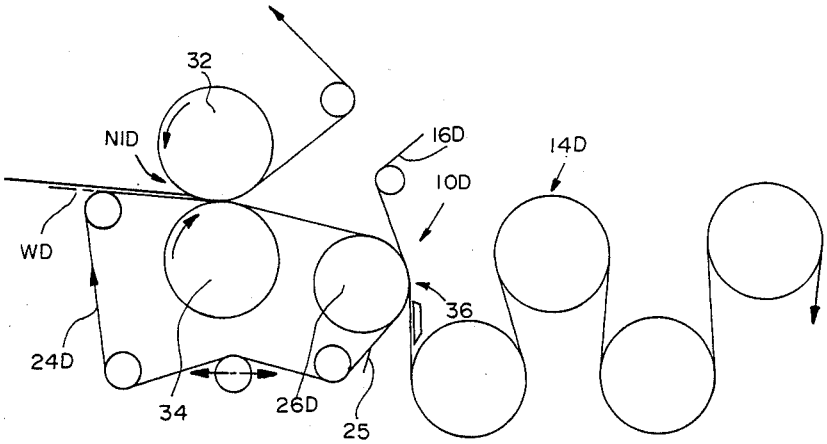
FIG. 5 is a side-elevational view of the transfer apparatus according to a first embodiment of the present invention.

FIG. 5 is a side-elevational view of a transfer apparatus generally designated 10D according to a first embodiment of the present invention for transferring a web WD from a press nip N1D to a dryer section generally designated 14D. The transfer apparatus 10D includes a backing roll 32 and a press member 34 which cooperates with the backing roll 32 for defining therebetween the press nip N1D. A press blanket 24D extends through the press nip N1D such that the web WD is disposed between the blanket 24D and the backing roll 32 during passage of the web WD through the press nip N1D. A backing drum 26D is disposed downstream relative to the press nip N1D such that the blanket 24D and the web WD extend contiguously relative to each other from the press nip N1D to the backing drum 26D. A dryer felt 16D cooperates with the backing drum 26D such that the web WD is disposed between the blanket 24D and the felt 16D during passage of the blanket 24D, web WD and felt 16D around the backing drum 26D. A transfer means generally designated 36 is disposed adjacent to the backing drum 26D for transferring the web WD from the blanket 24D to the felt 16D such that the web WD follows the felt 16D through the dryer section 14D.

FIG. 5 also shows the transfer apparatus as including a doctor blade 25 which is disposed downstream relative to the backing drum 26D for doctoring the web WD from the blanket 24D.

Figure 6:
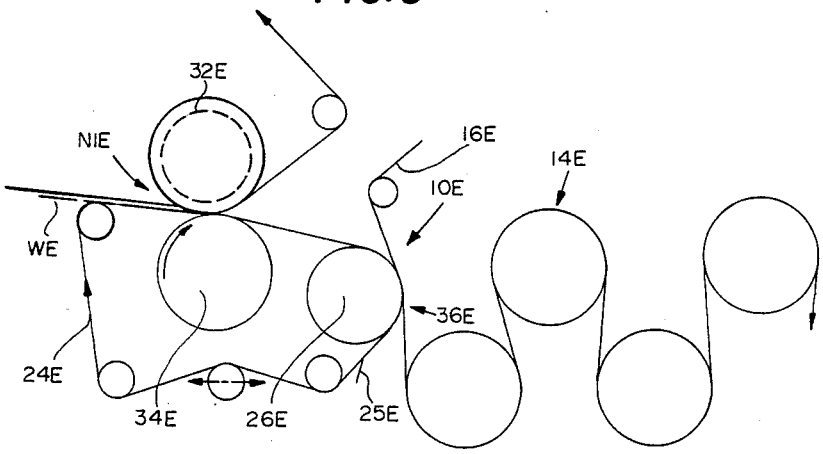
FIG. 6 is a side-elevational view of a second embodiment of the present invention.

In a second embodiment of the present invention as shown in FIG. 6, the backing roll 32E is vented.

Figure 7:
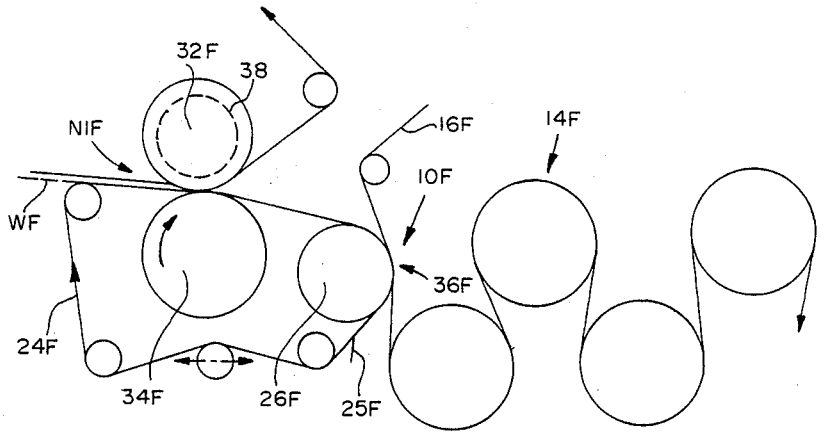
FIG. 7 is a side-elevational view of a third embodiment of the present invention.

In a third embodiment of the present invention as shown in FIG. 7, the backing roll 32F defines a plurality of grooves 38 such that water removed from the web WF during passage of the web WF through the press nip N1F flows through the grooves 38 for venting the press nip N1F.

Figure 8:
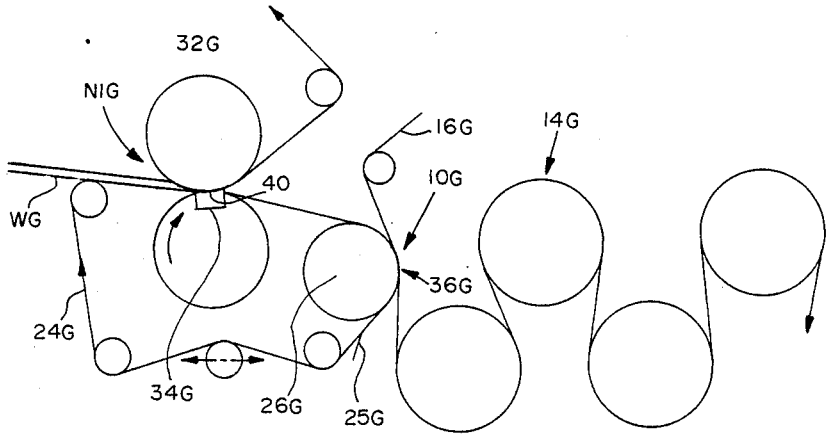
FIG. 8 is a side-elevational view of a fourth embodiment of the present invention.

In a fourth embodiment of the present invention as shown in FIG. 8, the press member 34G is a press shoe, defining a concave surface 40 which cooperates with the backing roll 32G for defining therebetween an extended nip N1G.

In the first embodiment of the present invention as shown in FIG. 5, the press member 34 is a press roll.

In each of the embodiments shown in FIGS. 5–8, the press blanket is an impervious belt which defines a smooth surface towards the web.

As shown in FIGS. 5–8, the various transfer apparatus include a dryer felt which extends around a portion of the circumference of the backing drum such that the felt, the web and the blanket together wrap around the portion of the circumference of the backing drum with the blanket and the web being disposed between the backing drum and the felt.

Figure 9:
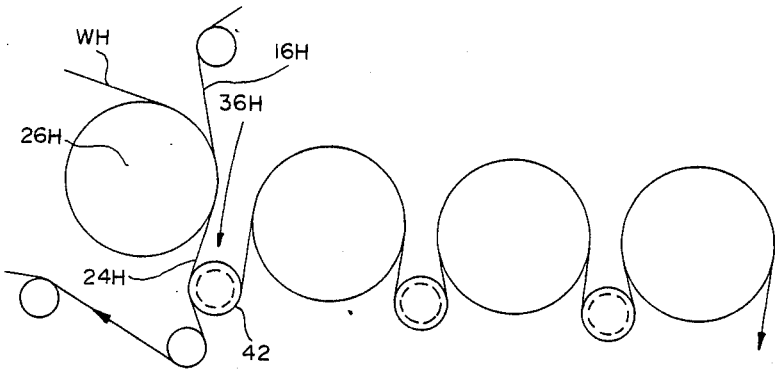
FIG. 9 is a side-elevational view of a fifth embodiment of the present invention.

FIG. 9 shows a fifth embodiment of the present invention in which the transfer means generally designated 36H includes a vacuum transfer roll 42 disposed downstream relative to the backing drum 26H such that the web WH is disposed between the blanket 24H and the dryer felt 16H from the backing drum 26H to the vacuum transfer roll 42 so that the web WH follows the felt 16H when the felt 16H diverges relative to the blanket 24H downstream relative the vacuum transfer roll 42.

Figure 10:
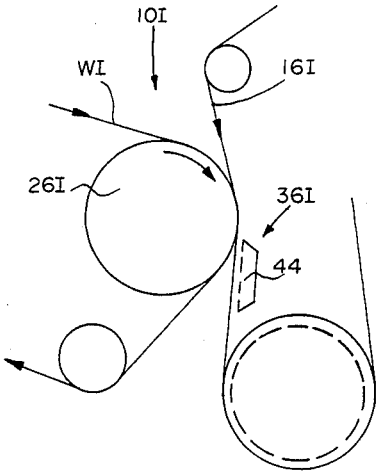
FIG. 10 is a side-elevational view of a sixth embodiment of the present invention.

FIG. 10 is a side-elevational view of a sixth embodiment of the present invention showing a transfer apparatus generally designated 10I wherein the transfer means generally designated 36I includes a vacuum box 44 disposed downstream relative to the backing drum 26I. The vacuum box 44 is disposed adjacent to a joint run of the dryer felt 16I and the web WI such that the dryer felt 16I is disposed between the web WI and the vacuum box 44 with the web WI thereafter extending around a vented roll.

Figure 11:
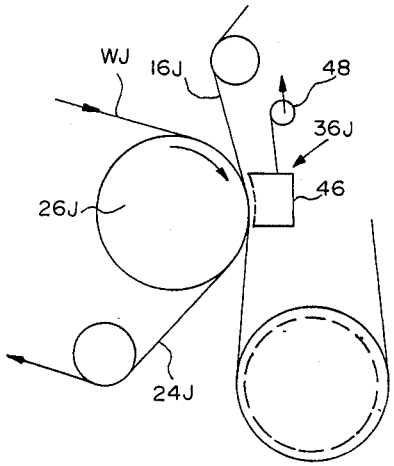
FIG. 11 is a side-elevational view of a seventh embodiment of the present invention.

FIG. 11 shows a seventh embodiment of the present invention in which the transfer means 36J includes a vacuum box 46 which is disposed radially relative to the backing drum 26J such that when the vacuum box 46 is connected to a source of partial vacuum 48, air flows through the vacuum box 46 adjacent to the backing drum 26J for drawing the web WJ into close conformity with the dryer felt 16J as the dryer felt 16J diverges relative to the blanket 24J thereby transferring the web WJ to the dryer felt 16J.

Figure 12:
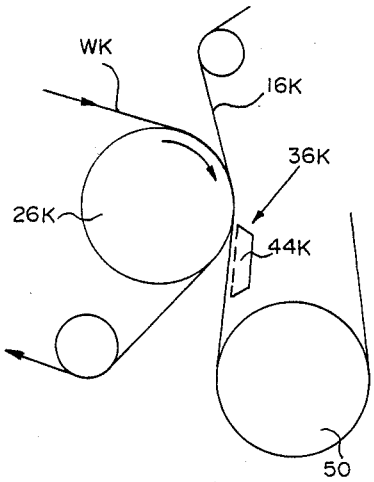
FIG. 12 is a side-elevational view of an eighth embodiment of the present invention.

FIG. 12 is an eighth embodiment of the present invention in which a dryer drum 50 is disposed downstream relative to the transfer means 36K such that the dryer felt 16K and the web WK extend contiguously relative to each other from the backing drum 26K to the dryer drum 50.

Figure 13:
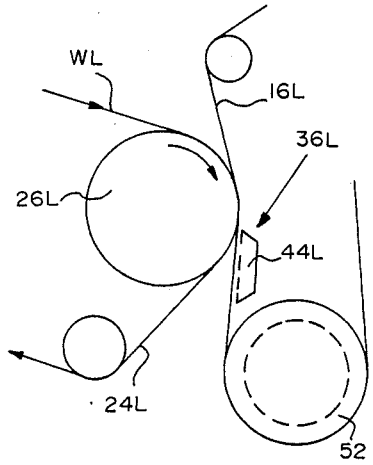
FIG. 13 is a side-elevational view of a ninth embodiment of the present invention.

As shown in FIG. 13 a ninth embodiment of the present invention includes a grooved roll 52 which is disposed downstream relative to the backing drum 26L such that the dryer felt 16L and the web extend contiguously relative to each other from the backing drum 26L to the grooved roll 52.

Figure 14:
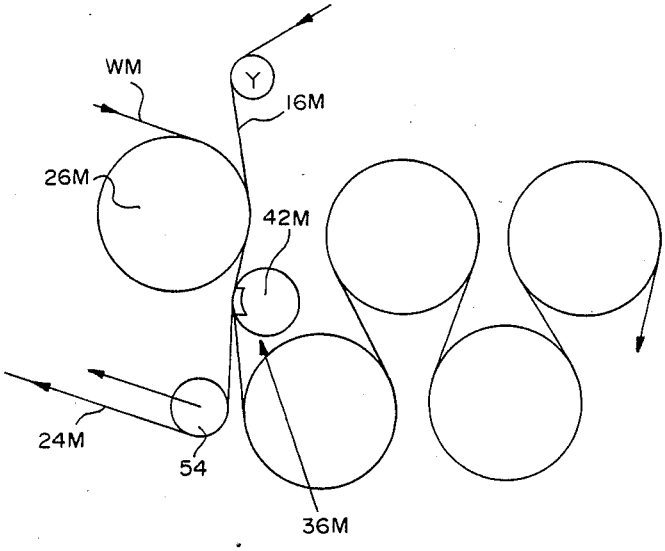
FIG. 14 is a side-elevational view of a tenth embodiment of the present invention showing a guide roll towards the dryer felt.
Figure 15:
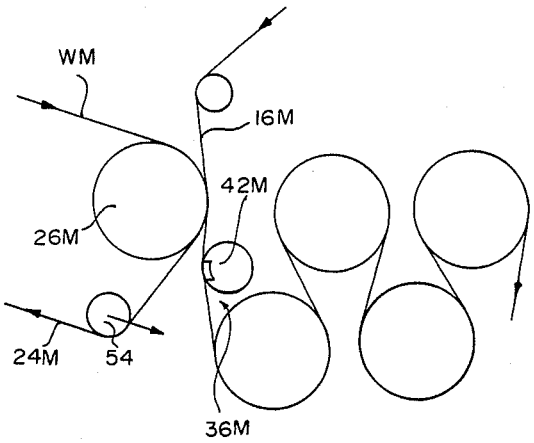
FIG. 15 is a side-elevational view of the tenth embodiment of the present invention as shown in 14 but with the guide roll moved away from the dryer felt.

FIGS. 14 and 15 show a tenth embodiment of the present invention in which an adjustable guide roll 54 is disposed downstream relative to the backing drum 26M for guiding the blanket 24M, the guide roll 54 being movable towards, and away from, the dryer felt 16M. FIG. 14 shows the guide roll 54 disposed in a first position with the guide roll 54 moved towards a vacuum roll 42M. FIG. 15 shows the guide roll 54 moved away from the vacuum roll 42M.

More particularly, as shown in FIGS. 14 and 15, the transfer means generally designated 36M includes the vacuum roll 42M which is disposed downstream relative to the backing drum 26M such that the dryer felt 16M and the web WM extend contiguously from the backing drum 26M to the vacuum roll 42M so that in a first position of the guide roll 54 as shown in FIG. 14, the guide roll 54 is moved towards the vacuum roll 42M so that the blanket 24M, the web WM and the dryer felt 16M extend contiguously from the backing drum 26M to the vacuum roll 42M for initially transferring the web WM from the blanket 24M to the dryer felt 16M. When the guide roll 54 is disposed in a second position thereof, as shown in FIG. 15, away from the vacuum roll 42M, the web WM continues to run contiguously with, and supported by, the dryer felt 16M from the backing drum 26M to the vacuum roll 42M.

Figure 16:
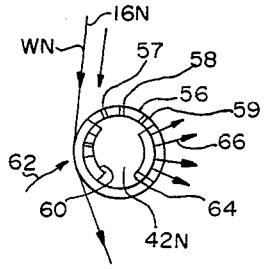
FIG. 16 is an enlarged side-elevational view of an eleventh embodiment of the present invention.

FIG. 16 is an enlarged side-elevational view of an eleventh embodiment of the present invention in which a vacuum roll 42N also includes a rotatable shell 56 defining a plurality of air flow passages 57,58,59. A vacuum chamber 60 is disposed adjacent to the dryer felt 16N such that in use of the apparatus, air indicated by the arrow 62 flows through the passages 57 to 59 into the vacuum chamber 60 for drawing the web WN into close conformity with the dryer felt 16N. A pressure chamber 64 is defined by the vacuum roll 42N and is disposed diametrically opposite to the vacuum chamber 60 such that air flows from the pressure chamber 64 as shown by the arrows 66 through the passages 57 to 59 outwardly away from the vacuum roll 42N for cleaning the passages 57 to 59 as the shell 56 rotates.

Figure 17:
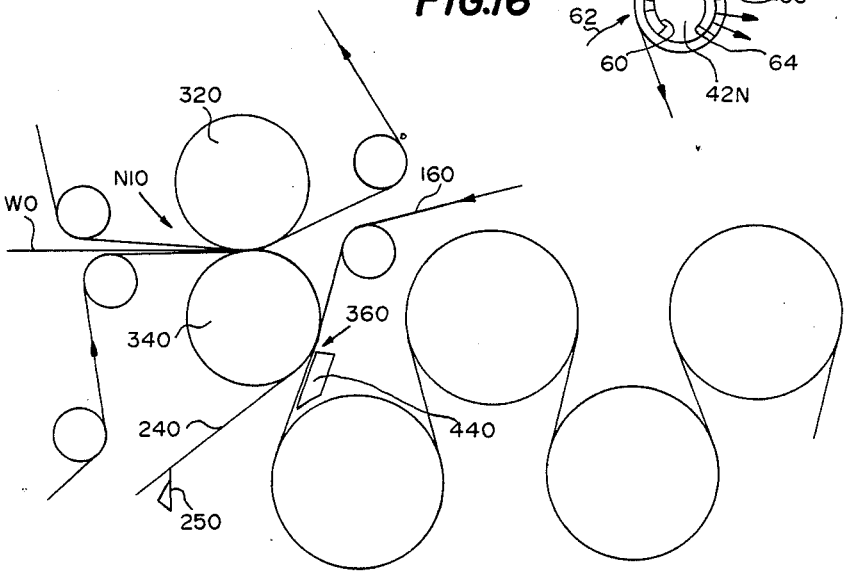
FIG. 17 is a side-elevational view of a twelfth embodiment of the present invention.

FIG. 17 is a side-elevational view of a twelfth embodiment to the present invention showing a press-nip N10 defined by a backing roll 320 and a press member 340. The web WO separates from the press felt and continues in close conformity with the press member 340 and a doctor 250 removes the web WO from the blanket 240. A dryer felt 160 cooperates with the press member 340 downstream relative to the press nip N1O for defining a transfer means generally designated 360. More specifically, the transfer means 360 includes a vacuum box 440 for transferring the web WO from the blanket 240 to the dryer felt 160 such that the press member 340 serves the dual purpose of a press member and a backing drum.

Figure 18:
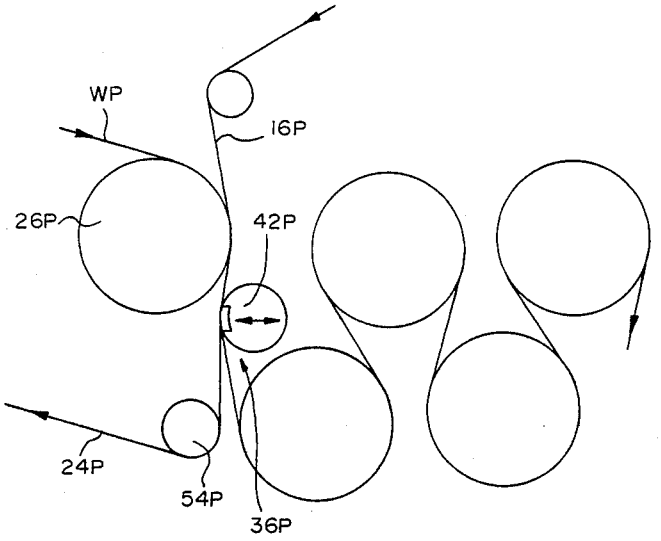
FIG. 18 is a side-elevational view of a thirteenth embodiment to the present invention showing the suction roll in an inoperative position thereof.

FIG. 18 is a side-elevational view of a thirteenth embodiment to the present invention and shows a backing drum 26P with the blanket 24P and the web WP running in close conformity with the blanket 24P from the backing drum 26P to the roll 54P. A movable suction roll 42P is disposed downstream relative to the backing drum 26P with the dryer felt 16P disposed between the suction roll 42P and the web WP. As shown in FIG. 18, the suction roll 42P is disposed towards from the web WP such that the web WP follows the felt 16P and not the blanket 24P downstream relative to the backing drum 26P.

Figure 19:
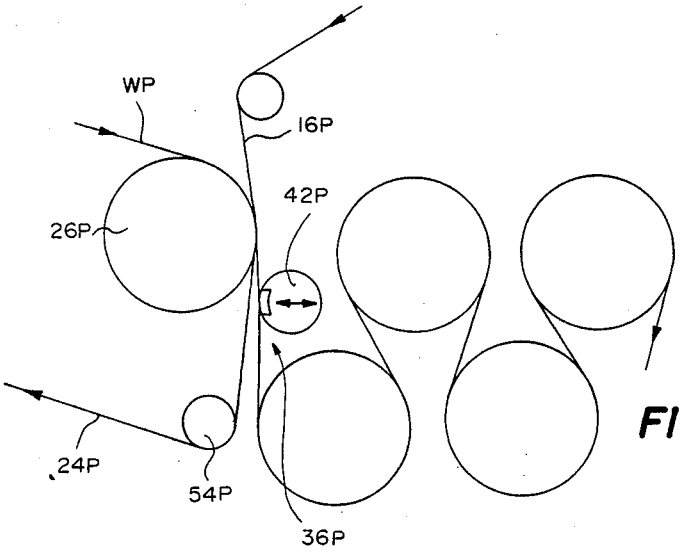
FIG. 19 is a side-elevational view of the embodiment shown in FIG. 18 but with the suction roll in the operative position thereof.

However, after the web has been transferred to the dryer section, the suction roll 42P is moved away the blanket 24P, as shown in FIG. 19. The web WP remains in contact with the dryer felt 16P and continues to extend to the dryer section. Due to the application of suction to the web WP by the suction roll 42P, the web WP continues to follow the dryer felt 16P downstream relative to the suction roll 42P so that the web WP is transferred to the dryer section by the transfer means generally designated 36P. Alternatively, when the web WP has been established on the press blanket 24P, the suction roll 42P can be moved to the position shown in FIG. 18 and the web WP will be transferred to the dryer section.

In operation of all of the various embodiments shown in FIGS. 5–16 and 18 and 19 of the present invention, the web is transferred without open draw from a press nip to a dryer section. The web is pressed between a backing roll and a press member which cooperates with the backing roll for defining therebetween the press nip. The pressed web supported by the press blanket is transported from the press nip towards, and around, the backing drum. The web is sandwiched between the blanket and a dryer felt which extends around a portion of the circumference of the backing drum. Vacuum is applied through the dryer felt downstream relative to the backing drum such that when the dryer felt diverges relative to the blanket downstream relative to the backing drum, the web follows the dryer felt through the dryer section.

In operation of the embodiment shown in FIG. 17, the web WO follows in close conformity with the blanket 240 around the press member 340 downstream relative to the nip N1O and is transferred for the blanket 240 by the vacuum box 440 to the dryer felt 160.

The present invention provides a simple and efficient means for transferring a pressed web without open draw from a press section to a dryer section without rewetting the web by contact of the web with a press felt. More particularly, the present invention provides a simple means for transferring the pressed web from the smooth surface of a pressing blanket such that the web is transferred without open draw to, and thereafter follows, a dryer felt through the dryer section.

What is claimed is:

1. A transfer apparatus for transferring a web from a press nip to a dryer section, said apparatus comprising:

a backing roll;

a press member cooperating with said backing roll for defining therebetween the press nip;

a press blanket defining an endless loop, said press blanket extending through the press nip such that the web is disposed between said blanket and said backing roll during passage of the web through the press nip;

a backing drum disposed downstream relative to the press nip and inside said endless loop such that said blanket and the web extend contiguously relative to each other from the press nip to said backing drum;

a dryer felt and said blanket moving around and cooperating with a portion of the circumference of said backing drum such that the web is sandwiched between said blanket and said felt during passage of said blanket, web and felt around said portion of the circumference of said backing drum; and transfer means disposed adjacent to said backing drum for transferring the web without open drawn from said blanket to said felt such that the web follows said felt through the dryer section.

2. A transfer apparatus as set forth in claim 1 wherein said backing roll is vented.

3. A transfer apparatus as set forth in claim 2 wherein said backing roll defines a plurality of grooves such that any water removed from the web during passage of the web through the press nip flows through said grooves for venting the press nip.

4. A transfer apparatus as set forth in claim 1 wherein said press member is a press shoe, said press shoe defining a concave surface with cooperates with said backing roll for defining therebetween an extended nip.

5. A transfer apparatus as set forth in claim 1 wherein said press member is a press roll.

6. A transfer apparatus as set forth in claim 1 wherein said press blanket is an impervious belt defining a smooth surface towards the web.

7. A transfer apparatus as set forth in claim 1 wherein said transfer means includes:

a vacuum transfer roll disposed downstream relative to said backing drum such that the web is disposed between said blanket and said felt from said backing drum to said vacuum transfer roll so that the web follows said felt, said felt diverging relative to said blanket downstream relative to said vacuum transfer roll.

8. A transfer apparatus as set forth in claim 1 wherein said transfer means includes:

a vacuum box disposed downstream relative to said backing drum, said vacuum box being disposed adjacent to a joint run of said dryer felt and the web such that said dryer felt is disposed between the web and said vacuum box.

9. A transfer apparatus as set forth in claim 1 wherein said transfer means includes:

a vacuum box disposed radially relative to said backing drum such that when said vacuum box is connected to a source of partial vacuum, air flows through said vacuum box adjacent to said backing drum for drawing the web into close conformity with said dryer felt as said dryer felt diverges relative to said blanket thereby transferring the web without open draw to said dryer felt.

10. A transfer apparatus as set forth in claim 1 further including:

a dryer drum disposed downstream relative to said transfer means such that said dryer felt and the web extend contiguously relative to each other from said backing drum to said dryer drum.

11. A transfer apparatus as set forth in claim 1 further including:

a grooved roll disposed downstream relative to said backing drum such that said dryer felt and the web extend contiguously relative to each other from said backing drum to said grooved roll.

12. A transfer apparatus as set forth in claim 1 further including:

an adjustable guide roll disposed downstream relative to said backing drum for guiding said blanket, said guide roll being movable towards, and away from, said dryer felt;

said transfer means including:

a vacuum roll disposed downstream relative to said backing drum such that said dryer felt and the web extend contiguously from said backing drum to said vacuum roll so that in a first position of said guide roll, said guide roll is towards said vacuum roll so that said blanket, the web and said dryer felt extend contiguously from said backing drum to said vacuum roll for initially transferring the web from said blanket to said dryer felt and when said guide roll is disposed in a second position thereof away from said vacuum roll, the web continues to run contiguously with, and supported by, said dryer felt from said backing drum to said vacuum roll.

13. A transfer apparatus as set forth in claim 13 wherein said vacuum roll further includes:

a rotatable shell defining a plurality of air flow passages;

a vacuum chamber disposed adjacent to said dryer felt such that in use of the apparatus air flows through said passages into said vacuum chamber for drawing the web into close conformity with said dryer felt;

a pressure chamber defined by said vacuum roll and disposed diametrically opposite to said vacuum chamber such that air flows from said pressure chamber through said passages outwardly away from said vacuum roll for cleaning said passages.

14. A transfer apparatus as set forth in claim 1 further including:

a doctor disposed downstream relative to said backing drum for doctoring the web from said blanket.

15. A transfer apparatus as set forth in claim 1 wherein said transfer means includes:

a vacuum roll movable towards and away from said blanket;

said vacuum roll being disposed downstream relative to said backing drum such that said dryer felt and the web extend contiguously from said backing drum to said vacuum roll so that in a first position of said vacuum roll, said vacuum roll is towards said blanket so that said blanket, the web and said dryer felt extend contiguously from said backing drum to said vacuum roll for initially transferring the web from said blanket to said dryer felt and when said vacuum roll is disposed in a second position thereof away from said blanket, the web continues to run contiguously with, and supported by, said dryer felt from said backing drum to said vacuum roll.

16. A transfer apparatus for transferring a web from a press nip to a dryer section, said apparatus comprising:

a backing roll;

a press member cooperating with said backing roll for defining therebetween the press nip;

a press blanket defining an endless loop, said press blanket extending through the press nip such that the web is disposed between said blanket and said backing roll during passage of the web through the press nip;

a backing drum disposed downstream relative to the press nip and inside said endless loop such that said blanket and the web extend contiguously relative to each other from the press nip to said backing drum;

a dryer felt and said blanket moving around and cooperating with a portion of the circumference of said backing drum such that the web is sandwiched between said blanket and said felt during passage of said blanket, web and felt around said portion of the circumference of said backing drum;

an adjustable guide roll disposed downstream relative to said backing drum for guiding said blanket, said guide roll being movable towards, and away from, said dryer felt;

transfer means disposed downstream relative to said backing drum for transferring the web from said blanket to said felt such that the web follows said felt through the dryer section; and said transfer means being disposed downstream relative to said backing drum such that said dryer felt and the web extend contiguously from said backing drum to said transfer means so that in a first position of said guide roll, said guide roll is toward said transfer means so that said blanket, the web and said dryer felt extend contiguously from said backing drum to said transfer means for initially transferring the web from said blanket to said dryer felt and when said guide roll is disposed in a second position thereof away from said transfer means, the web continues to run contiguously with, and supported by, said dryer felt from said backing drum to said transfer means.

17. A transfer apparatus for transferring a web from a press nip to a dryer section, said apparatus comprising:

a backing roll;

a press member cooperating with said backing roll for defining therebetween the press nip;

a press blanket extending through the press nip such that the web is disposed between said blanket and said backing roll during passage of the web through the press nip;

a dryer felt cooperating with said press member downstream relative to said press nip, said dryer felt and said blanket extending around a portion of a circumferential surface of said press member such that the web is disposed between said blanket and said felt downstream relative to said press nip; and transfer means disposed downstream relative to said press nip and adjacent to said press member for transferring the web without open drawn from said blanket to said felt such that the web follows said felt through the dryer section.

18. A method of transferring a web from a press nip to a dryer section, said method comprising the steps of:

pressing the web between a backing roll and a press member while the web is being supported by a press blanket, said press member cooperating with the backing roll for defining therebetween the press nip;

transporting the pressed web as the pressed web is being supported by the press blanket from the press nip towards, and around a portion of the circumferential backing drum, the blanket defining an endless loop such that the backing drum is disposed inside the loop;

sandwiching the web between the blanket and a dryer felt both of which extend around said portion of the circumference of the backing drum; and applying a vacuum through the dryer felt downstream relative to the backing drum, the dryer felt diverging relative to the blanket downstream relative to the backing drum, so that the web follows the dryer felt through the dryer section.

* * * * *

UNITED STATES PATENT AND TRADEMARK OFFICE
CERTIFICATE OF CORRECTION

PATENT NO. : 4,943,351

DATED : July 24, 1990

INVENTOR(S) : Gregory L. Wedel

It is certified that error appears in the above-identified patent and that said Letters Patent is hereby corrected as shown below:

| | | | | | | |
|---|---|---|---|---|---|---|
| Column 6, | line 15: | delete "cl". | | | | |
| Column 9, | line 41: | delete "N10" | and | insert | therefor | --N1O-- |
| | line 41: | delete "320" | and | insert | therefor | --32O-- |
| | line 42: | delete "340" | and | insert | therefor | --34O-- |
| | line 44: | delete "340" | and | insert | therefor | --34O-- |
| | line 44: | delete "250" | and | insert | therefor | --25O-- |
| | line 45: | delete "240" | and | insert | therefor | --24O-- |
| | line 45: | delete "160" | and | insert | therefor | --16O-- |
| | line 46: | delete "340" | and | insert | therefor | --34O-- |
| | line 47: | delete "360" | and | insert | therefor | --36O-- |
| | line 48: | delete "360" | and | insert | therefor | --36O-- |
| | line 49: | delete "440" | and | insert | therefor | --44O-- |
| | line 50: | delete "240" | and | insert | therefor | --24O-- |
| | line 50: | delete "160" | and | insert | therefor | --16O-- |
| | line 51: | delete "340" | and | insert | therefor | --34O-- |
| Column 10, | line 29: | delete "240" | and | insert | therefor | --24O-- |
| | line 29: | delete "340" | and | insert | therefor | --34O-- |
| | line 31: | delete "240" | and | insert | therefor | --24O-- |
| | line 31: | delete "440" | and | insert | therefor | --34O-- |
| | line 31: | delete "160" | and | insert | therefor | --16O-- |

UNITED STATES PATENT AND TRADEMARK OFFICE
CERTIFICATE OF CORRECTION

PATENT NO. : 4,943,351

DATED : July 24, 1990

INVENTOR(S) : Gregory L. Wedel

It is certified that error appears in the above-identified patent and that said Letters Patent is hereby corrected as shown below:

Column 10, line 64: delete "drawn" and insert therefor --draw--

Column 11, line 8: delete "with" and insert therefor --which-- (first occurrence)

Column 11, line 38: after the word "felt", insert --,--.(1st occur) Same line, delete the word "as". Same line, delete the word "diverges" and insert therefor --diverging--.

Column 14, line 5: delete "drawn" and insert therefor --draw--

Column 14, lines 17-18: delete "circumferential" and insert therefor --circumference of--

Signed and Sealed this

Eighth Day of October, 1991

*Attest:*

HARRY F. MANBECK, JR.

*Attesting Officer*

*Commissioner of Patents and Trademarks*